US009340749B1

(12) United States Patent
Kozyuk et al.

(10) Patent No.: US 9,340,749 B1
(45) Date of Patent: May 17, 2016

(54) METHOD FOR DEGUMMING TRIGLYCERIDE OILS

(71) Applicant: Arisdyne Systems, Inc., Cleveland, OH (US)

(72) Inventors: Oleg Kozyuk, North Ridgeville, OH (US); Peter Reimers, Shaker Heights, OH (US); Paul A. Reinking, North Olmstead, OH (US)

( * ) Notice: Subject to any disclaimer, the term of this patent is extended or adjusted under 35 U.S.C. 154(b) by 0 days.

(21) Appl. No.: 14/705,221

(22) Filed: May 6, 2015

(51) Int. Cl.
*C11B 3/00* (2006.01)
*C11B 3/04* (2006.01)

(52) U.S. Cl.
CPC ..... *C11B 3/04* (2013.01)

(58) Field of Classification Search
CPC ..... C11B 3/04
USPC ..... 554/190
See application file for complete search history.

(56) References Cited

U.S. PATENT DOCUMENTS

| | | | | |
|---|---|---|---|---|
| 4,698,185 | A | 10/1987 | Dijkstra et al. | |
| 5,696,278 | A | 12/1997 | Segers | |
| 5,717,181 | A | 2/1998 | Colgate | |
| 5,810,052 | A | 9/1998 | Kozyuk | |
| 5,931,771 | A | 8/1999 | Kozyuk | |
| 5,937,906 | A | 8/1999 | Kozyuk | |
| 5,969,207 | A | 10/1999 | Kozyuk | |
| 6,001,640 | A | 12/1999 | Loeffler et al. | |
| 6,012,492 | A | 1/2000 | Kozyuk | |
| 6,015,915 | A | 1/2000 | Jamil et al. | |
| 6,035,897 | A | 3/2000 | Kozyuk | |
| 6,172,248 | B1 * | 1/2001 | Copeland | A23D 9/00 554/190 |
| 6,190,538 | B1 | 2/2001 | Gosselink et al. | |
| 6,426,423 | B1 | 7/2002 | Copeland et al. | |
| 7,135,155 | B1 | 11/2006 | Long, Jr. et al. | |
| 7,713,727 | B2 | 5/2010 | Dayton et al. | |
| 7,762,715 | B2 | 7/2010 | Gordon et al. | |
| 7,935,157 | B2 | 5/2011 | Kozyuk et al. | |
| 8,042,989 | B2 | 10/2011 | Gordon et al. | |
| 8,911,808 | B2 | 12/2014 | Gordon et al. | |
| 8,945,644 | B2 | 2/2015 | Gordon et al. | |
| 2009/0306419 | A1 | 12/2009 | Myong et al. | |
| 2012/0181216 | A1 | 7/2012 | Kozyuk et al. | |
| 2013/0011887 | A1 | 1/2013 | Dayton et al. | |
| 2013/0062249 | A1 | 3/2013 | Kozyuk et al. | |

(Continued)

FOREIGN PATENT DOCUMENTS

| | | | |
|---|---|---|---|
| CA | 2644085 | A1 | 9/2007 |
| EP | 2592133 | B1 | 6/2014 |

(Continued)

OTHER PUBLICATIONS

International Search Report and Written Opinion in parent PCT application PCT/US2015/029388, issued Sep. 30, 2015.

(Continued)

*Primary Examiner* — Deborah D Carr
(74) *Attorney, Agent, or Firm* — Pearne & Gordon LLP

(57) ABSTRACT

A multi-stage homogenization method for degumming triglyceride oil is used to increase oil yield and reduce impurities. Two high-pressure homogenizers are used in series. The homogenizers have multiple flow constrictions to finely disperse reagents in the oil while simultaneously suppressing cavitation in the fluid. A separation step can be used to remove the phosphatides and other impurities from the treated oil to form a purified oil product.

20 Claims, 1 Drawing Sheet

(56) References Cited

U.S. PATENT DOCUMENTS

| | | | |
|---|---|---|---|
| 2014/0010725 | A1 | 1/2014 | Hassan et al. |
| 2014/0087042 | A1 | 3/2014 | Gordon et al. |
| 2014/0099687 | A1 | 4/2014 | Gordon et al. |
| 2014/0363855 | A1 | 12/2014 | Gordon et al. |

FOREIGN PATENT DOCUMENTS

| | | | | |
|---|---|---|---|---|
| RU | 2288948 | C1 | 12/2006 | |
| RU | 2333942 | C1 | 9/2008 | |
| SE | EP 2592133 | B1 * | 6/2014 | ..... C11B 3/001 |

OTHER PUBLICATIONS

Gogate et al., A review and assessment of hydrodynamic cavitation as a technology for the future; Ultrasonics Sonochemistry, 2005, vol. 12, pp. 21-27, Elsevier.

Gogate, et al., Cavitation: A technology on the horizon; Current Science, 2006, vol. 91, No. 1, pp. 35-46, Research Account.

Gogate, et al., Engineering Design Methods for Cavitation Reactors II: Hydrodynamic Cavitation; AICHE Journal, 2000, vol. 46, No. 8, pp. 1641-1649.

Kumar, et al., Experimental quantification of chemical effects of hydrodynamic cavitation; Chemical Engineering Science, 2000, vol. 55, pp. 1633-1639, Pergamon.

Pandit, et al., Improve Reactions with Hydrodynamic Cavitation; Chemical Engineering Progress, May 1999, pp. 43-50, www.aiche.org.

Moulton, et al., Continuous Ultrasonic Degumming of Crude Soybean Oil; Journal of American Oil Chemists Society, Jan. 1990, vol. 67, No. 1, pp. 33-38, Springer.

Nano cavitation: a proven new concept; Processing & Technology, Aug./Sep. 2012, www.oilsandfatsinternational.com.

Greyt, et al., Use of Nano Reactors in Edible Oil Processing; 102end AOCS Annual Meeting, May 1-4, 2011, Cincinnati, Ohio Presentation, www.desmetballestra.com.

The International Search Report and Written Opinion issued in International PCT Application No. PCT/US2014/070302; Mailing Date: Jul. 15, 2015.

* cited by examiner

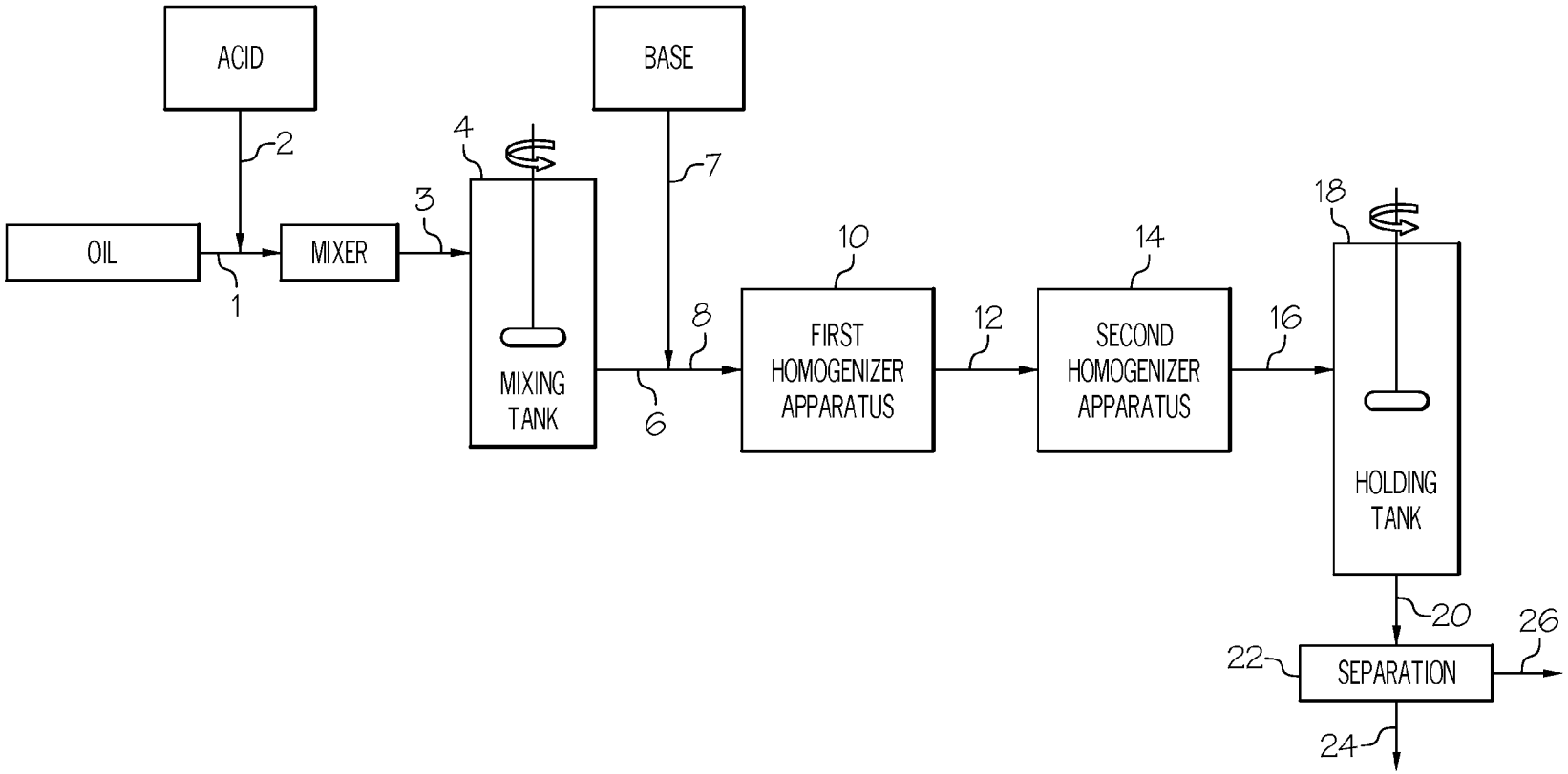
OIL
ACID
1
2
MIXER
3
4
MIXING TANK
BASE
7
6
8
10
FIRST HOMOGENIZER APPARATUS
12
14
SECOND HOMOGENIZER APPARATUS
16
18
HOLDING TANK
20
22
SEPARATION
24
26

METHOD FOR DEGUMMING TRIGLYCERIDE OILS

FIELD

The invention relates to improved processes for refining oils, and more particularly, improved processes for degumming triglyceride oils having impurities.

BACKGROUND

Vegetable oils are typically oils that have been pressed or extracted, such as from a vegetable source. Many vegetable oils contain some form of phosphatides (e.g., hydratable or non-hydratable), commonly known as gums. For instance, soybean oil contains about 1-3%, corn oil 0.6-0.9%, sunflower oil 0.5-0.9%, and canola oil (crude) 1-3% of gums.

Gums can be partially or totally removed from vegetable oils through several different known degumming processes. The most commonly used processes in the industry are water degumming, acid degumming, caustic refining and enzymatic degumming, for example, as disclosed in U.S. Pat. Nos. 4,049,686; 5,239,096; 5,264,367; 5,286,886; 6,001,640; 6,033,706; 7,494,676 and 7,544,820, and U.S. Pat. Pub. Nos. 2007/0134777; 2008/0182322 and 2012/0258017.

A method disclosed in U.S. Pat. No. 4,240,972 discloses adding an acid to a heated stream of crude vegetable oil and then immediately passing the mixture through a static mixer to produce an acid-in-oil dispersion, and then separating the dispersion into an oil phase and an aqueous phase containing the phosphatides. In another example, U.S. Pat. No. 4,698,185 describes a vegetable oil refining method with the steps of dispersing an aqueous organic acid in a water-degummed oil to form an acid-in-oil dispersion, allowing the phases to remain in contact for a time sufficient to decompose metal salts of phosphatidic acid, adding a base to the acid-in-oil dispersion to increase pH to above 2.5 without substantial formation of soap, and finally separating the dispersion into an oil phase and an aqueous phase containing the phosphatides.

U.S. Pat. Nos. 4,698,185 and 6,015,915 describe processes for degumming vegetable oil using a high shear Ultra-Turax rotor/stator apparatus. U.S. Pat. No. 6,172,248 describes a method for refining vegetable oils and byproducts thereof. In an organic acid refining process, vegetable oil is combined with a dilute aqueous organic acid solution and subjected to high shear to finely disperse the acid solution in the oil. High shear rotor/stator apparatus are known to be used to generate hydrodynamic cavitation in fluids.

Cavitation has a tendency to release dissolved gases in an oil mixture and generate post cavitation gas fields of tiny bubbles in the fluid flow. Those bubbles become coagulation centers for the soap stock particles, entrap oil in the larger agglomerates and can decrease phase boundary in the oil-acid/base solution. As a result, the rate of hydrolysis of phosphatides, and the degree of removal thereof, in the purification process will decrease as the fields of bubbles persist in the fluid. Entrapment of the oil in the larger agglomerates can also increase oil yield losses.

A method disclosed in U.S. Pat. Pub. No. 2009/0314688; 2011/0003370, and 2014/0087042 involves mixing crude oil with degumming agents, e.g., water or acid, and passing the mixture through a hydrodynamic cavitation device. Numerous flow-through hydrodynamic apparatuses are known, for example, those disclosed in U.S. Pat. Nos. 5,810,052; 5,971,601; 5,969,207; 6,035,897; 6,502,979; 6,705,396; 7,338,551 and 7,207,712.

Cavitational processing provides the highest shear to oil degumming processes but at the same time extracts dissolved gases from liquids and generates post cavitation gas fields of tiny bubbles in the flow. Accordingly, there is a continuing need for a method for degumming that can provide the highest shear to the process but at the same time eliminate the cavitational degassing problem observed in known methods.

SUMMARY

A method for degumming a triglyceride oil can include the steps of mixing an aqueous base solution with an acid-treated oil to form a pre-treated oil mixture comprising an oil phase and a water phase. The pre-treated oil mixture at a pre-determined inlet pressure can be passed through two homogenization apparatuses in series with one another, for example, a first homogenization apparatus and a second homogenization apparatus, to form a treated oil mixture. The first and second homogenization apparatuses each include at least three flow constrictions in series for dispersing the contents, such as acid, base and water, of the pre-treated oil mixture. The pre-treated oil mixture is subjected to a pressure drop across each flow constriction in the first and second homogenization apparatuses in the range of 25 to 50 percent of the upstream pressure of the pre-treated oil mixture before each flow constriction. The pressure drop across each flow constriction is such that hydrodynamic cavitation in the pre-treated oil mixture is entirely avoided and suppressed in both the first and second homogenization apparatuses. The treated oil mixture can be further processed by separating the water phase from the oil phase to form a purified oil.

In one embodiment, the method can further include a step of mixing a triglyceride oil with an aqueous acid solution to form the acid-treated oil to be mixed with the base. The triglyceride oil can be mixed with the aqueous acid in a tank prior to mixing with the aqueous base solution with the acid-treated oil.

In another embodiment, the pre-determined inlet pressure of the pre-treated oil mixture prior to being passed through the first flow constriction in the first homogenization apparatus can be in the range of 800 to 2,000 psi. The pressure drop in the pre-treated oil mixture across the entire first homogenization apparatus, for example across all flow constrictions contained therein, can be in the range of 60 to 80% of the pre-determined inlet pressure.

In an example, the pressure drop in the pre-treated oil mixture across each flow constriction in the first homogenization apparatus can be at least 100 psi. In another example, the pressure drop in the pre-treated oil mixture across each flow constriction in the second homogenization apparatus can be not more than 100 psi.

In another embodiment, the pre-treated oil mixture enters the second homogenization apparatus at a second inlet pressure, the pressure drop in the pre-treated oil mixture across the second homogenization apparatus, for example across all flow constrictions contained there, can be in the range of 60 to 80% of the second inlet pressure. The treated oil mixture exiting the second homogenization apparatus can be at a pressure less than 10% of the pre-determined inlet pressure, e.g., in the range of 800 to 2,000 psi.

The pre-treated oil mixture in the first homogenization apparatus and the second homogenization apparatus can have a cavitation number continuously greater than 2 when calculated using the equation $C_v=(P-P_v)/0.5\rho V^2$, where $C_v$ is the cavitation number, P is the fluid pressure downstream of a constriction, $P_v$ is the vapor pressure of the water, $\rho$ is the density of the oil, and V is the velocity of the pre-treated oil mixture at a flow constriction. For example, the pre-treated oil mixture in the first homogenization apparatus and the second homogenization apparatus can have a cavitation number in the range of greater than 2 and less than 5.

In another embodiment, the flow constrictions in the first and second homogenization apparatuses can be valves. The valves can have a sharp edge surface for providing shear to the oil mixture, such as the valves having a knife edge.

The flow constrictions can be arranged in the first or second homogenization apparatuses radially in series or axially in series.

The method for degumming a triglyceride oil can yield a purified oil having a phosphorus content of less than 10 ppm.

The method can include an enzyme being added to the pre-treated oil mixture prior to the mixture being passed through the first and second homogenization apparatuses.

The triglyceride oil in the pre-treated oil mixture can be crude vegetable oil or water-degummed vegetable oil. The crude vegetable oil or water-degummed vegetable oil can be selected from the group consisting of acai oil, almond oil, babassu oil, blackcurrent seed oil, borage seed oil, canola oil, cashew oil, castor oil, coconut oil, coriander oil, corn oil, cottonseed oil, crambe oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil walnut oil or a mixture thereof.

The acid-treated oil can include an acid selected from the group consisting phosphoric acid, hydrochloric acid, sulfuric acid, ascorbic acid, acetic acid, citric acid, fumaric acid, maleic acid, tartaric acid, succinic acid, glycolic acid or a mixture thereof. The pre-treated oil mixture can include a base selected from the group consisting of sodium hydroxide, potassium hydroxide, sodium silicate, sodium carbonate, calcium carbonate or a mixture thereof.

BRIEF DESCRIPTION OF THE DRAWINGS

FIG. 1 shows a block flow diagram of an oil degumming method using first and second homogenization apparatus to reduce phosphatide levels in the oil being treated.

DETAILED DESCRIPTION

Herein, when a range such as 5-25 (or 5 to 25) is given, this means preferably at least 5 and, separately and independently, preferably not more than 25. In an example, such a range defines independently not less than 5, and separately and independently, not less than 25.

A method has been discovered for an efficient, cost-effective oil degumming process by use of a first and second homogenization apparatus combination. The oil to be treated is mixed with an acid, base and water. It has been found that a multi-stage flow constriction homogenization apparatus in series with another multi-stage flow constriction homogenization apparatus can improve reduction in phosphatide content with a higher oil yield. The first and second homogenization apparatuses contain multiple flow constrictions for dispersing the oil, acid, base and water such that hydrodynamic cavitation is suppressed in both homogenization apparatuses.

As illustrated in the diagram of FIG. 1, one embodiment of a method for degumming oils can include multiple stages. As shown in the drawing, pipes, hoses, or other conventional, industrial equipment can be used to facilitate the fluid communication of the elements and streams discussed below.

Oil is shown as stream 1 in FIG. 1. The oils that can be degummed include vegetable oils, such as crude vegetable oil or water-degummed oil. Examples of vegetable oils can include, for example, acai oil, almond oil, babassu oil, blackcurrent seed oil, borage seed oil, canola oil, cashew oil, castor oil, coconut oil, coriander oil, corn oil, cottonseed oil, crambe oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil, walnut oil or combinations thereof.

The phosphatide or phosphorus content of the oil 1 can be in the range of 30 to 1,200 ppm. The phosphatide content (or also referred to as phospholipid content), as used herein, is expressed as ppm phosphorus in oil. In an example, the phosphatide content of crude oil, such as vegetable crude oil, can be in the range of 200 to 1,200 ppm phosphorus. In another example, the phosphatide content of previously water-degummed oil, such as water-degummed vegetable oil, can be in the range of 30 to 200 ppm phosphorus.

The oil 1 can be heated prior to the degumming method (not shown), such as prior to acid being added to form an acid-treated oil. For example, the oil can be passed through a heat exchanger, such as a plate and frame heat exchanger, to increase or decrease the temperature of the oil as desired. The oil can be heated to a temperature in the range of 20 to 100° C., or at least to 30, 40, 50, 60, 70, 80, 90 or 100° C. Preferably, the oil is maintained at a temperature in the range of 40 to 95° C. during the degumming process as deemed suitable to one skilled in the art.

An acid, such as an aqueous acid solution, can be added to the oil to be degummed to form acid-treated oil 3. Acids can promote hydration of the non-hydrated phosphatides contained in the oil. The acid is shown as stream 2. The acid can include an inorganic or organic acid, for example, phosphoric acid, hydrochloric acid, sulfuric acid, ascorbic acid, acetic acid, citric acid, fumaric acid, maleic acid, tartaric acid, succinic acid, glycolic acid or a combination or mixture thereof. The acid is used in range from about 50 to 500 ppm as measured by weight of the oil. For example, a high concentration acid in water solution can be used, such as a 75 weight percent phosphoric acid water solution. The aqueous acid solution can be stored in a working or holding tank prior to being added to the oil 1.

The acid-treated oil 3 can optionally be passed through a mixer to disperse the acid 2 in the oil 1. Any suitable mixer can be used, for example, the use of a dynamic mixer is preferred to disperse the acid in the oil. Using a dynamic mixer can provide more effective mixing and promote the use of concentrated acid solutions, which can reduce the volume of acid solution being added to the oil. Examples of mixers that can be used include centrifugal pumps or in-line mixers.

The acid-treated oil 3 can be optionally transferred to a holding or mixing tank 4. The tank 4 can store or further mix the acid-treated oil for a suitable predetermined amount of time. For example, the acid-treated oil can be held for a period of 1 minute to 24 hours. The tank can be equipped with a mixer or stirrer for maintaining a homogenous mixture. The tank can be jacketed or equipped with another heating apparatus, such as coils, for maintaining a desired holding temperature (not shown).

A base, such as in an aqueous base solution, can be added to and mixed with the acid-treated oil 6 to form a pre-treated oil mixture 8, for example before being passed through a first homogenization apparatus 10. The base can be added to neutralize the acid-oil mixture, for instance, to bring the pH of the mixture to a range of 5 to 8, and preferably 6 to 7. The base can promote the neutralization of free fatty acids contained in the acid-oil mixture. The base can be stored in a working or holding tank prior to being added to the acid-treated oil. The base is shown as stream 7.

The base 7 can include sodium hydroxide, potassium hydroxide, sodium silicate, sodium carbonate, calcium carbonate, or combinations thereof. The base can be used in range from 0.02 to 0.2 percent by weight based on total weight of the oil in the acid-treated oil. Concentrated base solutions, for instance, between 30 and 50 weight percent, can be used to reduce the amount of volume of base solution being added. Beyond the stoichiometric amount of base required to neutralize the acid and free fatty acids in the acid-oil mixture, surplus base can be added, for example, to adjust for certain oils to be degummed and the quality thereof.

The pre-treated oil mixture 8, containing an oil phase and a water phase, is passed to a first homogenizer or homogenization apparatus 10. The pre-treated oil mixture 8 can be fed to the apparatus 10 by a pump. Preferably, the pre-treated oil mixture 8 is fed to the apparatus 10 at a pre-determined inlet pressure, for example, in the range of 800 to 2,000 psi, or at least 900, 1,000, 1,250 or 1,500 psi.

The first homogenization apparatus 10 can have multiple flow constrictions and preferably at least three flow constrictions in series. The pre-treated oil mixture 8, under pressure and at low velocity, is forced through each flow constriction where the velocity is increased and a corresponding decrease in pressure in the pre-treated oil mixture 8 results. The construction or design of the flow constriction can accelerate the mixture 8 radially. Passage through the flow constrictions, and the increase in velocity and pressure drop, releases energy that causes turbulence and localized pressure fluctuations that finely disperse the oil, acid, base and water mixture to promote an acid-oil interface for transferring impurities in the oil to the water phase.

In an example, the first homogenization apparatus 10 can be a high pressure valve homogenizer apparatus. The first homogenization apparatus 10 can have a sharp edge or knife edge element in close proximity with a ring or seat surface of a valve acting as the flow constriction. Knife edge valves are valves with a so called "sharp edge" or "knife edge" profile. Optionally, the valve has an impact surface, for instance a ring structure, surrounding a portion of the adjustable edge or knife edge of the valve. Homogenizer valves having a sharp or knife edge can generate high turbulence and shear conditions in the pre-treated oil mixture, which combined with compression, velocity acceleration, pressure drop and flow impact cause the formation of fine emulsion droplets while suppressing and avoiding flow-induced cavitation in the mixture.

The sharp edge or knife edge element can be adjustable to control the pressure drop of the pre-treated oil mixture across the flow constriction. For example, by adjusting the gap between the sharp edge or knife edge element and the seat of the valve, the flow area in the flow constriction of the homogenizing apparatus 10 is controlled and the resulting pressure drop in the pre-treated oil mixture is regulated such that the dispersion of fluids is magnified without subjecting the mixture to cavitation and degassing drawbacks thereof. As the mixture 8 flows through the flow constriction, e.g., exiting the valve around the seat or ring member, it can form a radial jet that strikes an impact surface such as an impact ring, for example, a ring member positioned on the valve seat and surrounding the sharp edge or knife edge portion closest to the seat. The impact surface blocks or creates an obstruction to the flow of the mixture near the gap between the seal and adjustable knife edge or sharp edge element of the valve.

The first homogenization apparatus 10 can be the high pressure homogenization devices supplied by APV Rannie Other homogenization apparatuses can be used, such as those manufactured by Bran+Leubbe or Niro Soavi that can produce high pressure, high shear homogenization in fluids. Yet other examples of suitable homogenization apparatuses can include the devices disclosed in U.S. Pat. Nos. 3,243,157; 3,515,370; 4,060,099; 5,451,106; 6,550,956 and 6,299,342.

Cavitation in the first homogenization apparatus 10 is suppressed by maintaining the pressure drop across each flow constriction at a level to avoid inducing or generating a cavitation bubble in the mixture 8, which eliminates degassing of fluid components. Each flow constriction in the apparatus 10 has an inlet pressure immediately upstream of the flow constriction and an exit pressure immediately downstream of the flow constriction, which defines a total pressure drop in the pre-treated mixture across a particular flow constriction. The pressure drop in the pre-treated oil mixture 8 across any flow constriction can be in the range of 25 to 50, or 30 to 40 percent of the upstream inlet pressure to the flow constriction. In an embodiment, the pressure drop in the mixture 8 across a flow constriction can be at least 30, 35, 40 or 45 percent of the upstream inlet pressure. In another embodiment, the pressure drop in the mixture 8 across a flow constriction can be in the range of 100 to 500 psi, or at least 125, 150. 175 or 200 psi.

The pressure drop in the pre-treated oil mixture 8 can be measured across the first homogenization apparatus 10, which includes the pressure drop across all flow constrictions contained therein. The pressure drop in the pre-treated oil mixture across the first homogenization apparatus can be in the range of 60 to 80 percent of the pre-determined inlet pressure to the apparatus, or at least 65, 70 or 75 percent. In one embodiment, the pressure drop in the pre-treated oil mixture across the first homogenization apparatus can be at least 250, 500 or 750 psi.

The pre-treated oil mixture 8 exits the first homogenization apparatus 10 in stream 12 and enters a second homogenization apparatus 14 at a second inlet pressure. The second inlet pressure of the pre-treated oil mixture 12 can be in the range of 100 to 1,000 psi, or at least 150, 200, 250, 300, 350 or 400 psi. In an embodiment, the pressure drop in the mixture 12 across a flow constriction in the second apparatus 14 can be at least 30, 35, 40 or 45 percent of the upstream inlet pressure to the constriction. In another embodiment, the pressure drop in the mixture 12 across a flow constriction can be in the range of 25 to 250 psi, or at least 30, 40, 50, 60, 70 or 80 psi.

The pressure drop in the pre-treated oil mixture 12 can be measured across the second homogenization apparatus 14, which includes the pressure drop across all flow constrictions contained therein. The pressure drop in the pre-treated oil mixture across the second homogenization apparatus can be in the range of 60 to 80 percent of the second inlet pressure to the apparatus 14, or at least 65, 70 or 75 percent. In one embodiment, the pressure drop in the pre-treated oil mixture 12 across the second homogenization apparatus can be at least 100, 125, 140, 150, 175 or 200 psi.

The second homogenization apparatus 14 can have multiple flow constrictions and preferably at least three flow constrictions in series. The second homogenization apparatus 14 can be the same apparatus as the first homogenization apparatus 10. Thus, all of the features of the second homogenization apparatus 14 can be the same as described above for the first homogenization apparatus 10, for example, the flow constrictions of the second apparatus 14 can be knife edge valves. The second homogenization apparatus 14 further disperses the oil phase and the water phase to promote oil degumming. Turbulence in the pre-treated oil mixture 12 and pressure drop of the mixture 12 through the second homogenization apparatus 14 is controlled in order to suppress the formation of cavitation bubbles in the mixture 12 throughout its entire passage through the apparatus 14.

The pre-treated oil mixtures 8, 12 can be characterized at points within each of the first and second homogenization apparatuses 10, 14 by a cavitation number. The cavitation number of the pre-treated oil mixture 8, 12 can be calculated using the equation $C_v=(P-P_v)/0.5\rho V^2$, where $C_v$ is the cavitation number, P is the fluid pressure of the mixture downstream of a flow constriction, $P_v$ is the vapor pressure of the water, ρ is the density of the oil, and V is the velocity of the pre-treated oil mixture at a flow constriction. A cavitation number above 1 indicates that cavitation does not occur in a fluid. The cavitation number should be above 1 but not high enough to reduce turbulence and mixing of the oil and reagents.

The pre-treated oil mixtures 8, 12 in the first and second homogenization apparatuses 10, 14 are continuously characterized by a cavitation number above 1, 1.5 or 2 such that cavitation is suppressed during processing of the mixture in the first and second homogenization apparatuses. In an example, the mixtures 8, 12 can have a cavitation number in the range of 2 to 5 within the first and second homogenization apparatuses, or greater than 2.2, 2.5, 2.8, 3, 3.2, 3.5 or 3.7. Likewise, the cavitation number of the mixture can be below 5, 4.5, 4, 3.5 or 3. In some embodiments, the cavitation number of the pre-treated oil mixture 8 in the first homogenization apparatus 10 at each flow constriction can be lower than the cavitation number of the pre-treated mixture 12 in the second homogenization apparatus 14 at each flow constriction. The pre-treated mixture 8 can have a cavitation number in the range of 2 to 3 within the first homogenization apparatus 10, for example at each flow constriction in the apparatus 10, and the pre-treated mixture 12 can have a cavitation number in the range of 3 to 5 or 3 to 4 within the second homogenization apparatus 14, for example at each flow constriction in the apparatus 14.

The occurrence of cavitation in the oil mixture can present disadvantages as discussed above. For example, flow-induced cavitation has the tendency for extracting dissolved gases from liquids and can generate post-cavitation gas fields of tiny cavitation bubbles in the liquid flow. The cavitation bubbles become coagulation centers for soap stock particles and impurities. The bubbles can further entrap oil in the larger agglomerates and can decrease phase boundary contact between the oil and acid/base solution. In this regard, the rate of hydrolysis of phosphatides, and the degree of removal thereof, in the oil degumming process will decrease because the intensity of the mass transfer at the interface or phase boundary contact area associated with the supply rate of the reactants, e.g., water, acid, base, through the phase interface will likewise decrease. Thus, the removal rate of the impurities of the catalytic reaction can decrease in the event of cavitation in the fluid. Suppressing flow-induced cavitation in homogenizer apparatuses can avoid these problems and promote a decrease oil yield losses as compared to cavitation methods.

Without being bound by any particular theory, it is believed that acid reacts with the non-hydratable phosphatides in the oil and decompose them. Because reagents can be diluted in an aqueous solution, such as an aqueous acid solution, a fine dispersion of the oil and reagent solution is desired. A fine dispersion is preferable when the reaction has to be near completion and low residual phosphatides and impurity content has to be reached. Accordingly, the dispersion has to be so fine that the reaction between the acid and the non-hydratable phosphatides is almost instantaneous or at least almost completed within seconds. A fine dispersion is also needed for neutralization reaction with a base. As aqueous base droplets are finely dispersed, the interface area between the base and the oil and acid will increase, and diffusion distances will decrease, which will increase the overall neutralization reaction. Thus, when carrying out degumming process under the proposed conditions, its intensification occurs, there results in an increase in efficiency of the method of degumming a triglyceride oil.

The method for degumming oils described herein is suitable for enzymatic degumming processes. In another embodiment, the oil 1 can be mixed with an enzyme for degumming the oil. Thus, the pre-treated oil mixture 8 can further include an enzyme as known in the art for use in degumming oils. Solutions or mixtures of enzymes in water can be dilute with low concentrations of enzyme, and those enzyme solutions are generally more dilute than aqueous solutions of acid or base as used in oil degumming. On a molar basis, the dispersion of the enzyme solution or mixture should be fine since the low concentration of enzymes and enzyme stearic requirements can lead to a lower Arrhenius factor for enzymatic reactions.

The dispersed oil being passed through the first and second homogenization apparatuses can be further processed. For example, the treated oil 16 exiting the second homogenization apparatus 14 can be transferred to one or more separation phases to remove the added water, acid, base or other component or a portion thereof and impurities from the oil phase to create a purified oil product. Prior to separation, the treated oil 16 can be transferred to a holding tank 18. The oil 16 can be mixed or allowed to rest in the holding tank as desired. From the holding tank, the treated oil 18, containing a water phase and an oil phase, can be processed to separate 22 the phases.

Separation of the water phase from the oil phase can be done with a decanter, centrifuge, hydrocyclone or similar separation equipment. The differences in densities of water and oil allows for a rapid and distinct separation of the two components. For example, if the separator is a gravity tank with a mixer or agitator, the residence time can be selected to allow for gravitational separation of the heavy phase and light phase as desired. Separation temperatures in a separation vessel can be adjusted as desired, for example, the separation temperature can be in the range of 20° C. to 150° C., 30° C. to 100° C. or 40° C. to 80° C. Preferably, the water and oil mixture can be introduced into a separation vessel at a temperature in the range of 20° C. to 60° C. From the separator 22, a water phase 24 and a purified oil 26 are formed. The purified oil 26 can be subjected to further processing steps known in the art including bleaching or deodorizing, as may be necessary or desirable depending on the end use for which the degummed oil product is intended.

The oil degumming methods described herein can be carried out at different temperatures, for instance, at any temperature deemed suitable by one of skill in the art. In certain embodiments, the temperature during the process is in the range from about 20° C. to 110° C. In certain embodiments, the temperature during the process is about 20, 30, 40, 50 60, 70, 80, 90, 100 or 110° C.

The purified oil 26 resulting from separation of water and impurities, such as soaps and phosphatides, has an improved quality. The phosphatide content of the purified oil can be less than 100, 90, 80, 70, 60, 50, 40, 35, 30, 20, 15, 10 or 5 ppm, whereas the starting phosphatide content of the oil being fed to the homogenization apparatuses can be in the range of 200 to 1200 for crude oils and 30 to 200 for water degummed oils. The degumming method described herein can result in a purified oil product having a reduction in phosphatide content of at least 80, 85, 90, 95, 97, 97.5, 98 or 98.5 weight percent, as compared to the oil being fed to the process or being used to form the acid-oil mixture. The iron content of the purified oil can be less than 0.15, 0.12, 0.10, 0.09, 0.08, 0.07, 0.06, 0.05, 0.04 or 0.03 ppm, whereas the starting iron content of the oil being fed to the homogenization apparatuses can be in the range of 0.4 to 5 ppm. The degumming method described herein can result in a purified oil product having a reduction in iron content of at least 80, 85, 90, 93, 94, 95, 96, 97, 97.5 or 98 weight percent, as compared to the oil being fed to the process or being used to form the acid-oil mixture.

In order to promote a further understanding of the invention, the following examples are provided. These examples are shown by way of illustration and not limitation.

Example 1

500 g of water-degummed soybean oil with a residual phosphorus content of 62 ppm and an iron content of 0.58 ppm was heated up to 70° C. 0.01 weight percent of phosphoric acid to oil (dosed as an 85 weight percent aqueous solution) was added to the soybean oil, followed by 5 minutes of mixing with a magnetic stirrer. 0.35 weight percent caustic soda to oil (dosed as a dilute 9.5 weight percent caustic soda solution) was added to obtain a pre-treated oil mixture. The pre-treated oil mixture was pressurized and followed by one pass at an inlet pressure of 1,000 psi through two three-stage knife edge valves high-pressure valve homogenizers (design similar to the sown in FIG. 5 U.S. Pat. No. 6,550,956) arranged in series (a first and second homogenization). In the first high-pressure valve homogenizer, a pressure drop across each homogenizing valve was about 40% from static pressure of the pre-treated oil mixture before each valve. Pressure drops across each valve in the first homogenizer were 400, 240 and 145 psi. In second high-pressure valve homogenizer, pressure drop across each homogenizing valve was about 30% from static pressure of the pre-treated oil mixture before each valve. Pressure drops across each valve in the second homogenizer were 65, 45 and 30 psi.

In the first high-pressure valve homogenizer the cavitation number $C_v$ for the pre-treated oil mixture across each homogenizing valve was 2.34, 2.40 and 2.44 and, accordingly, flow-induced cavitation was suppressed. In the second high-pressure valve homogenizer the cavitation number $C_v$ for the pre-treated oil mixture across each homogenizing valve was 3.53, 3.72 and 3.73 and, accordingly, flow-induced cavitation was suppressed. The cavitation number in each case was calculated using the equation: $C_v=(P-P_v)/0.5\rho V^2$, as described above.

The treated oil exiting the second high-pressure homogenizer was tested for impurity content. The phosphorus content of the purified oil was 2.0 ppm and the iron content was 0.04 ppm. This drop in impurity content in the purified oil yielded a 96.8 percent reduction in phosphorus and a 93.1 percent reduction in iron content.

Example 2

Crude soybean oil with a residual phosphorus content of 470 ppm and an iron content of 2.4 ppm was heated up to 80° C. 0.03 weight percent of phosphoric acid to oil (dosed as an 85 weight percent aqueous solution) was added to the soybean oil, followed by 5 minutes of mixing with a magnetic stirrer. 0.6 weight percent caustic soda to oil (dosed as a dilute 9.5 weight percent caustic soda solution) was added to obtain a pre-treated oil mixture. The mixture was subjected to same homogenization treatment of two three-stage knife edge valves high-pressure valve homogenizers arranged in series as described in Example 1. The pressure drop across each flow constriction and the calculated cavitation number were the same as described in Example 1.

In the purified soybean oil, the concentration of phosphorus dropped to 6.0 ppm and the iron content to 0.07 ppm. This drop in impurity content in the purified oil yielded a 97.8 percent reduction in phosphorus and a 97.1 percent reduction in iron content.

It will be understood that this invention is not limited to the above-described embodiments. Those skilled in the art having the benefit of the teachings of the present invention as hereinabove set forth, can effect numerous modifications thereto. These modifications are to be construed as being encompassed with the scope of the present invention as set forth in the appended claims.

What is claimed:

1. A method for degumming a triglyceride oil comprising:

a. mixing an aqueous base solution with an acid-treated oil to form a pre-treated oil mixture comprising an oil phase and a water phase;

b. passing the pre-treated oil mixture at a pre-determined inlet pressure through a first homogenization apparatus and a second homogenization apparatus to form a treated oil mixture, the first homogenization apparatus and the second homogenization apparatus positioned in series with one another and the first homogenization apparatus and the second homogenization apparatus each having at least three flow constrictions in series, wherein the pressure drop in the pre-treated oil mixture across each flow constriction in the first homogenization apparatus and the second homogenization apparatus is in the range of 25 to 50% of the upstream pressure of the pre-treated oil mixture before each flow constriction such that hydrodynamic cavitation in the pre-treated oil mixture is suppressed in the first homogenization apparatus and the second homogenization apparatus;

c. separating the water phase from the oil phase to form a purified oil.

2. The method of claim 1, further comprising mixing a triglyceride oil with an aqueous acid solution to form the acid-treated oil.

3. The method of claim 2, further comprising mixing the triglyceride oil with the aqueous acid solution in a tank prior to mixing the aqueous base solution with the acid-treated oil.

4. The method of claim 1, the pre-determined inlet pressure of the pre-treated oil mixture to the first homogenization apparatus being in the range of 800 to 2,000 psi.

5. The method of claim 4, the pressure drop in the pre-treated oil mixture across the first homogenization apparatus being in the range of 60 to 80% of the pre-determined inlet pressure.

6. The method of claim 4, the pressure drop in the pre-treated oil mixture across each flow constriction in the first homogenization apparatus being at least 100 psi.

7. The method of claim 1, the pre-treated oil mixture enters the second homogenization apparatus at a second inlet pressure, the pressure drop in the pre-treated oil mixture across the second homogenization apparatus being in the range of 60 to 80% of the second inlet pressure.

8. The method of claim 1, the treated oil mixture exiting the second homogenization apparatus at a pressure less than 10% of the pre-determined inlet pressure.

9. The method of claim 1, the pre-treated oil mixture in the first homogenization apparatus and the second homogenization apparatus having a cavitation number greater than 2 when calculated using the equation $C_v=(P-P_v)/0.5\rho V^2$, where $C_v$ is the cavitation number, P is the pre-treated oil mixture pressure downstream of a flow constriction, $P_v$ is the vapor pressure of the water, ρ is the density of the oil, and V is the velocity of the pre-treated oil mixture at a flow constriction.

10. The method of claim 9, the pre-treated oil mixture in the first homogenization apparatus and the second homogenization apparatus having a cavitation number in the range of greater than 2 and less than 5.

11. The method of claim 1, the flow constrictions in the first homogenization apparatus and the second homogenization apparatus being valves.

12. The method of claim 11, the valves having a knife edge.

13. The method of claim 1, the flow constrictions in the first homogenization apparatus or the second homogenization apparatus being positioned radially in series.

14. The method of claim 1, the flow constrictions in the first homogenization apparatus or the second homogenization apparatus being positioned axially in series.

15. The method of claim 1, the purified oil having a phosphorus content of less than 10 ppm.

16. The method of claim 1, the pre-treated oil mixture further comprising an enzyme.

17. The method of claim 1, the pre-treated oil mixture comprising crude vegetable oil or water-degummed vegetable oil.

18. The method of claim 17, the crude vegetable oil or water-degummed vegetable oil being selected from the group consisting of acai oil, almond oil, babassu oil, blackcurrent seed oil, borage seed oil, canola oil, cashew oil, castor oil, coconut oil, coriander oil, corn oil, cottonseed oil, crambe oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil walnut oil or a mixture thereof.

19. The method of claim 1, the acid-treated oil comprising an acid selected from the group consisting phosphoric acid, hydrochloric acid, sulfuric acid, ascorbic acid, acetic acid, citric acid, fumaric acid, maleic acid, tartaric acid, succinic acid, glycolic acid or a mixture thereof.

20. The method of claim 1, the aqueous base solution comprises a base selected from the group consisting of sodium hydroxide, potassium hydroxide, sodium silicate, sodium carbonate, calcium carbonate or a mixture thereof.

* * * * *

UNITED STATES PATENT AND TRADEMARK OFFICE

CERTIFICATE OF CORRECTION

PATENT NO. : 9,340,749 B1
APPLICATION NO. : 14/705221
DATED : May 17, 2016
INVENTOR(S) : Kozyuk et al.

It is certified that error appears in the above-identified patent and that said Letters Patent is hereby corrected as shown below:

On the title page:

Item (75) please delete "North Olmstead, OH (US)" and replace it with -- North Olmsted, OH (US) --

Signed and Sealed this
Second Day of August, 2016

Michelle K. Lee

Michelle K. Lee
*Director of the United States Patent and Trademark Office*